United States Patent [19]

Johnson, deceased et al.

[11] Patent Number: 4,571,117

[45] Date of Patent: Feb. 18, 1986

[54] METHOD AND APPARATUS FOR FORMING AN ICE ROAD OVER SNOW-COVERED TERRAIN

[76] Inventors: Paul Johnson, deceased, late of Anchorage, Ak.; by Marie Johnson, administratrix, 2331 Captain Cook Dr., Anchorage, Ak. 99503

[21] Appl. No.: 698,532

[22] Filed: Feb. 5, 1985

[51] Int. Cl.[4] ..... E01C 21/00; E01C 23/06; E01C 23/14

[52] U.S. Cl. ..... 404/77; 404/95

[58] Field of Search ..... 404/72, 77, 79, 95, 404/96, 101

[56] References Cited

U.S. PATENT DOCUMENTS

| | | | |
|---|---|---|---|
| 1,930,309 | 10/1933 | Gallagher | 404/95 |
| 2,169,987 | 8/1939 | Mosel | 404/101 X |
| 2,394,017 | 2/1946 | Seaman | 404/95 |
| 2,589,256 | 3/1952 | Horning | 404/101 X |
| 3,053,311 | 9/1962 | Nottage | 404/95 X |
| 3,221,617 | 12/1965 | Quigg | 404/95 |
| 3,361,042 | 1/1968 | Cutler | 404/101 X |
| 3,363,523 | 1/1968 | Brock | 404/95 |
| 3,371,586 | 3/1968 | Nikolaev | 404/79 X |
| 3,986,783 | 10/1976 | Rowley | 404/95 |
| 3,989,401 | 11/1976 | Moench | 404/95 |

*Primary Examiner*—James A. Leppink
*Assistant Examiner*—John F. Letchford
*Attorney, Agent, or Firm*—Burns, Doane, Swecker & Mathis

[57] ABSTRACT

An ice road is formed over snow-covered terrain by traversing a pair of rearwardly converging snow gathering blades over the snow-covered terrain to form a continuous snow ridge. The top of the ridge is leveled with a leveling blade. A heater comprising an inclined heated plate and a plurality of downwardly depending fore-to-aft extending vanes is passed along the ridge to melt some of the snow therein and form a slush of water and snow of generally uniform depth and width, and of a temperature of about 32° F. The slush is allowed to at least partially freeze while confined beneath a horizontal unheated plate which shapes the ice road. Freezing is completed upon exposure of the ice road to ambient air. The vanes are angled relative to the direction of travel and contain apertures to promote mixing of the water and snow as melting progresses.

6 Claims, 7 Drawing Figures

METHOD AND APPARATUS FOR FORMING AN ICE ROAD OVER SNOW-COVERED TERRAIN

BACKGROUND AND OBJECTS OF THE INVENTION

The present invention relates to the construction of roads in extremely cold regions.

In regions of the world which are subject to severely cold climatic conditions, such as Alaska for example, the transportation of equipment and materials over snow-covered icy terrain, presents unique problems. For example, the transfer of materials and personnel engaged in oil/gas exploration or drilling operations may require that some sort of "road" or surface be formed which is capable of supporting the transport vehicles.

In such regions, the use of conventional road building materials and techniques is impractical. Accordingly, it has heretofore been the practice to form ice roads of frozen salt water. The salt water is pumped up from beneath the ice by means of an auger which cuts through the ice and transports the salt water upwardly and flows it onto the top of the terrain. There is no way to control the water, which seeks its own level and thus may extend 200 to 300 feet in width, in some cases, before freezing. Additional holes would be augered to extend the length of the ice "road".

Roads constructed in that manner exhibit serious drawbacks. For example, it is difficult to control the liquid to form desired road widths and depths. Moreover, since the road is formed atop areas from which salt water has been drawn, there may occur a tendency for the packed ice to sink as the salt water is removed. The salt concentration in the water is also a source of difficulty, because the presence of salt lengthens the freeze period and lowers the melting point. This hampers formation of the road and facilitates its deterioration. Machinery operating over the road is, of course, subject to the corrosive effects of the salt.

It is, therefore, an object of the present invention to minimize or obviate problems of the above-discussed type.

Another object of the present invention is to provide apparatus and techniques for forming highly stable ice roads.

A further object of the invention is to enable ice roads to be formed of salt-free water.

An additional object of the invention is to enable ice roads to be formed of available surface snow and ice.

SUMMARY OF THE INVENTION

These objects are achieved by the present invention which involves methods and apparatus for forming an ice road over snow-covered terrain. A ridge forming implement is traversed over the snow-covered terrain to form the snow into an elongated ridge extending along the path of travel. A heating implement is traversed along the ridge to form a slush of water and snow of generally uniform depth and width, which slush is allowed to freeze to form the ice road.

The heating implement preferably comprises a heating plate which is inclined downwardly to the rear, and a plurality of generally fore-to-aft extending vertical vanes depending downwardly from the heating plate. At least some of the vanes are angled relative to the path of travel and contain apertures, to facilitate blending of water and unmelted snow to form the slush.

Preferably, a horizontal unheated plate is situated behind the heating plate to shape the slush as it freezes.

Preferably, the slush which is formed is at a temperature of about 32° F. so that an ice road can be formed merely by transforming the water from the liquid state into the solid state.

Preferably, the components of the machine are carried upon a mobile frame which includes movable ground supports. The frame can be pulled, pushed, or rendered self-propelled. An operator's cabin can be mounted on the frame to accommodate operating personnel.

THE DRAWINGS

The objects and advantages of the invention will become apparent from the following detailed description of a preferred embodiment thereof, in connection with the accompanying drawings in which like numerals designate like elements, and in which.

DETAILED DESCRIPTION OF A PREFERRED EMBODIMENT OF THE INVENTION

Figure 1:
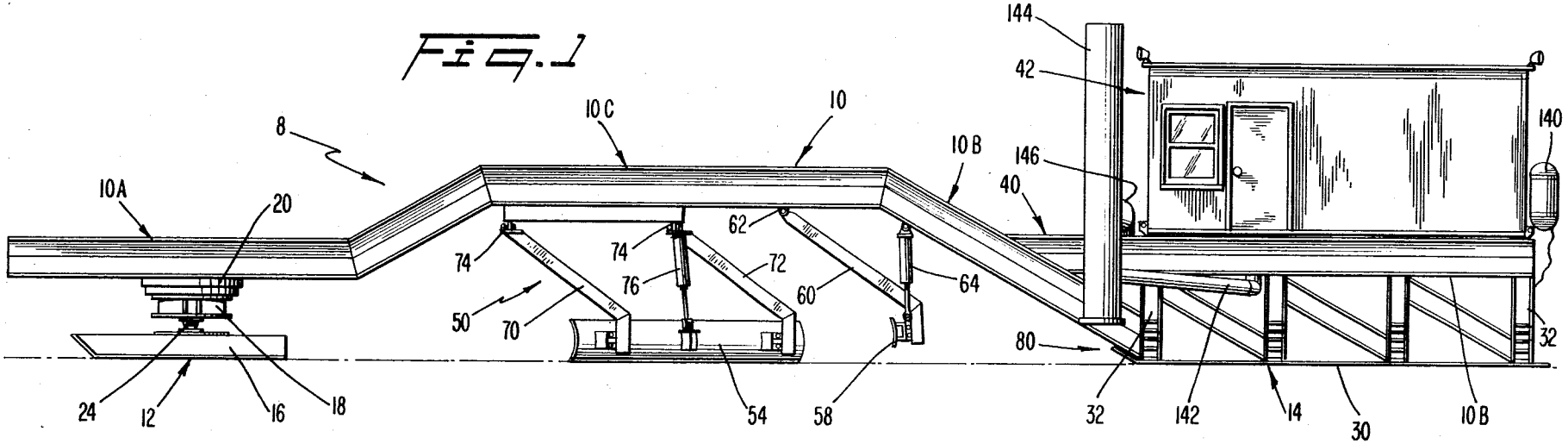
FIG. 1 is a side elevational view of an ice road forming machine according to the present invention.

A preferred ice road forming machine 8 according to the present invention comprises a frame 10 which carries ground or terrain supports 12, 14 at its front and rear ends 10A, 10B, respectively. The front terrain support 12 comprises a pair of parallel, fore-to-aft extending skids 16 mounted upon a turntable 18. The turntable 18 is mounted within a bearing structure 20 on the frame 10 for rotation relative to the frame 10 about a vertical axis. Such rotation can be produced in any suitable manner, such as by hydraulically actuated ram-type motors connected between the frame 10 and turntable 18. Alternatively, the turntable can be attached to a drawbar which is coupled to a towing vehicle; by manipulating the drawbar from the towing vehicle, the front skids 16 can be turned to steer the frame.

The skids 16 are each mounted to the turntable by a horizontal transverse pivot pin 24 to allow the skids to "float" across uneven terrain.

Figure 7:
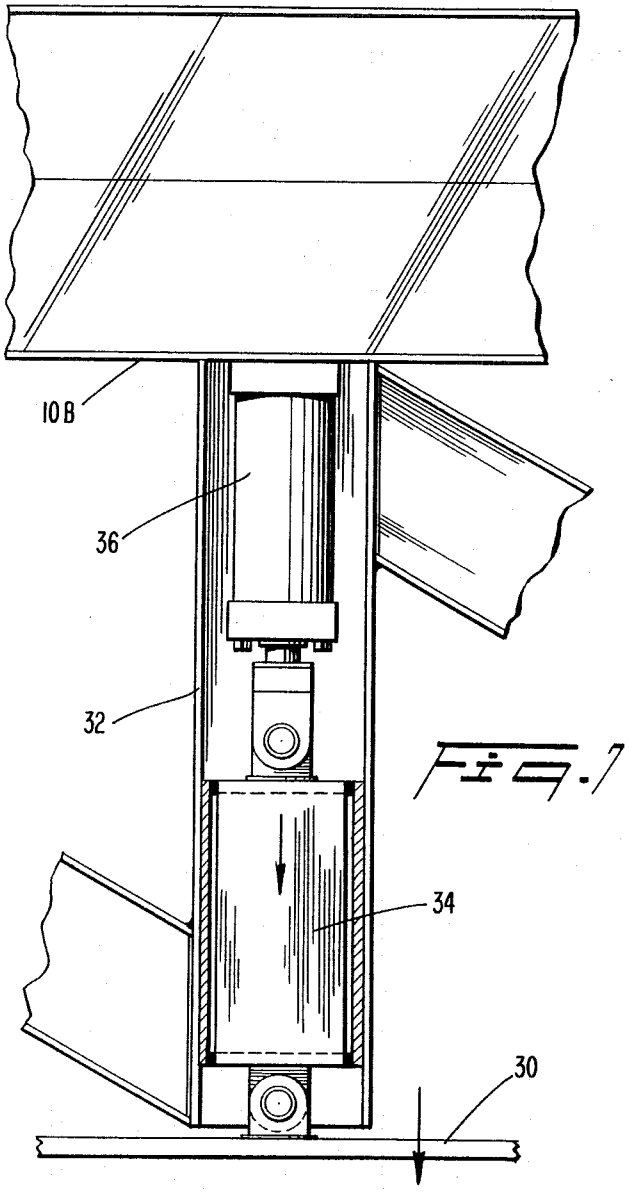
FIG. 7 is a side elevational view of a mechanism for elevating rear skids of the machine.
Figure 6:
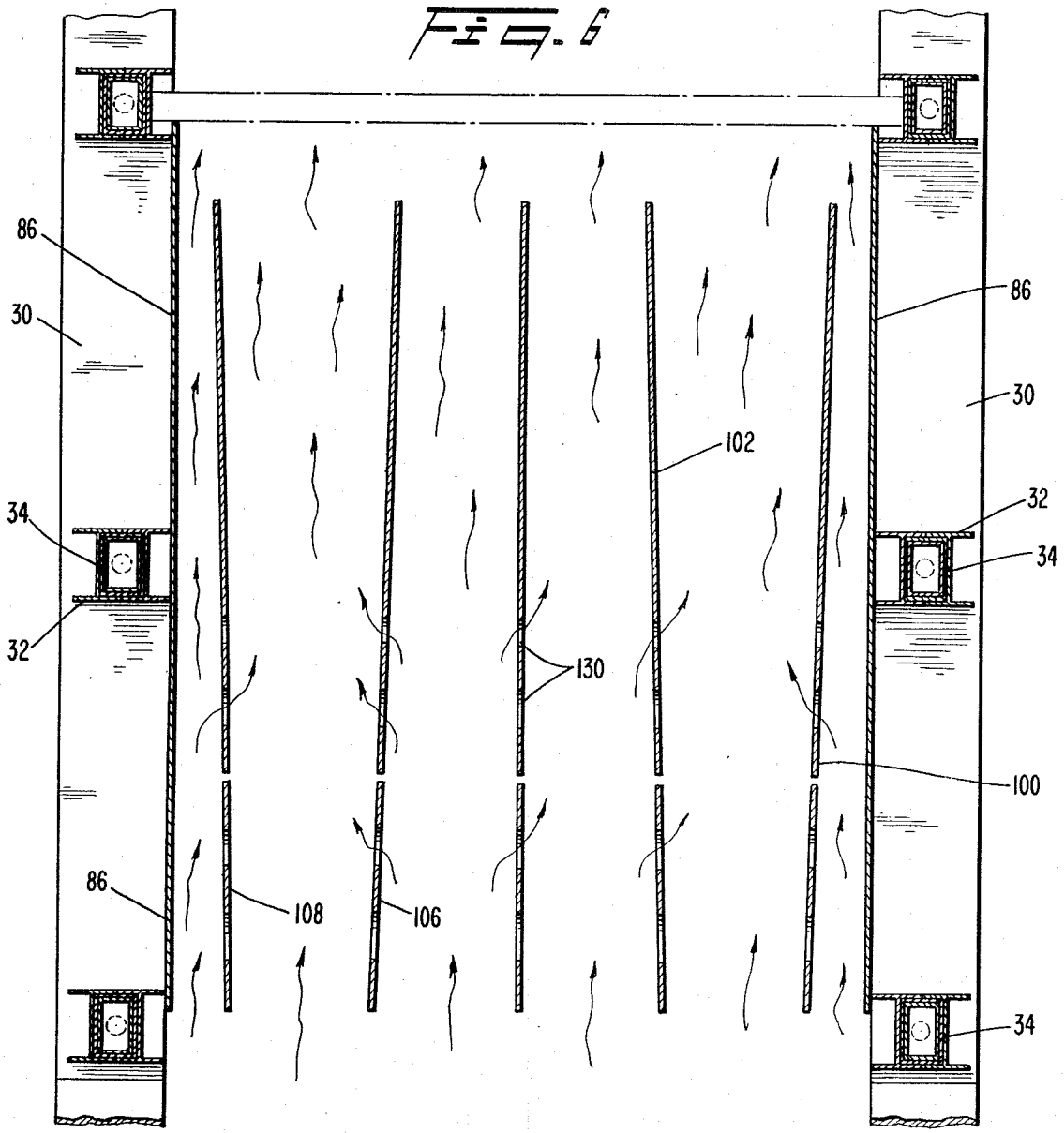
FIG. 6 is a schematic representation, in horizontal section taken along line 6—6 in FIG. 5, depicting the arrangement of melting vanes according to the invention.

The rear terrain support 14 comprises a pair of skids 30 each mounted beneath a plurality of columns 32. The rear skids 30 are each affixed at the lower ends of slides or cylinders 34 which are vertically slidable within the respective column (FIG. 7). Hydraulic rams 36 are operably connected between the rear frame section 10B and the tops of the sliding cylinders 34 to raise and lower the latter. In this fashion, the elevation of the rear frame section can be regulated. At least two cylinders and ram assemblies 34, 36 are connected to each rear skid 30.

A platform 40 is supported on the rear frame section 10C over the rear skids 30. An enclosed cabin 42 is disposed on the platform. The cabin 42 has a controlled environment and houses operating personnel, an electric generating system, heating apparatus, and other equipment. Lubricants, hydraulic fluids, spare parts, and fuel cells can be sored at the front end of the frame or elsewhere, it being desirable to isolate all fuels and flamables the greatest possible distance from the power generating and heating systems and personnel. Advantageously, such an arrangement of components produces a more uniform weight distribution along the frame.

The front and rear frame sections 10A, 10B are connected to an intermediate frame section 10C. Preferably, these frame sections 10A, B, C are each of unitary design and may constitute modules which can be bolted or welded together at the job site.

Figure 2:
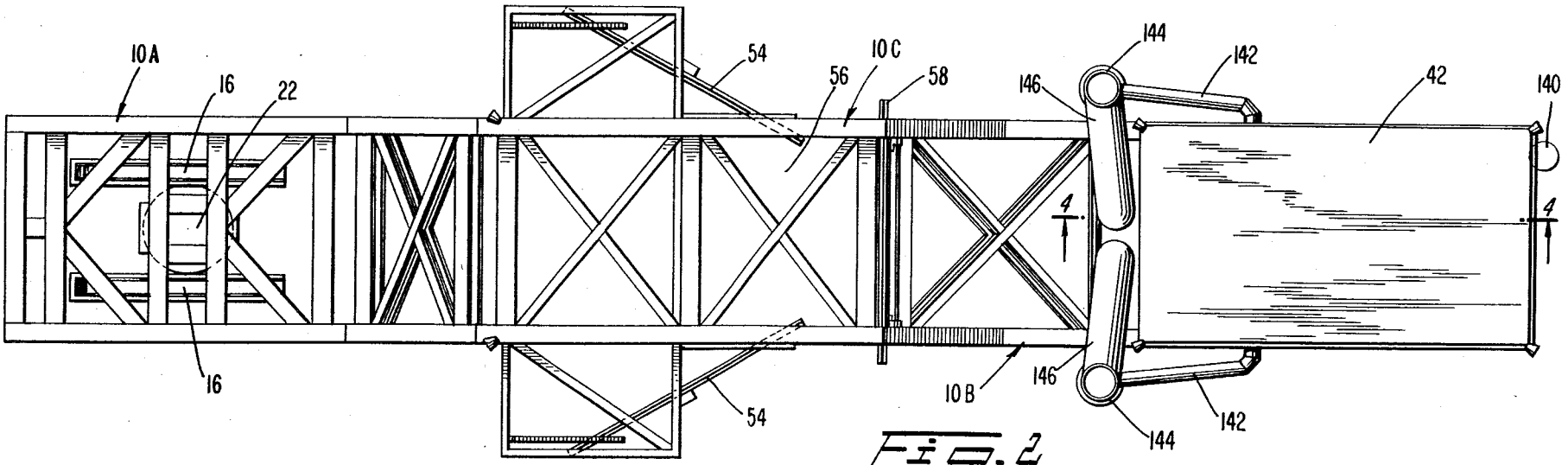
FIG. 2 is a plan view of the machine depicted in FIG. 1.
Figure 3:
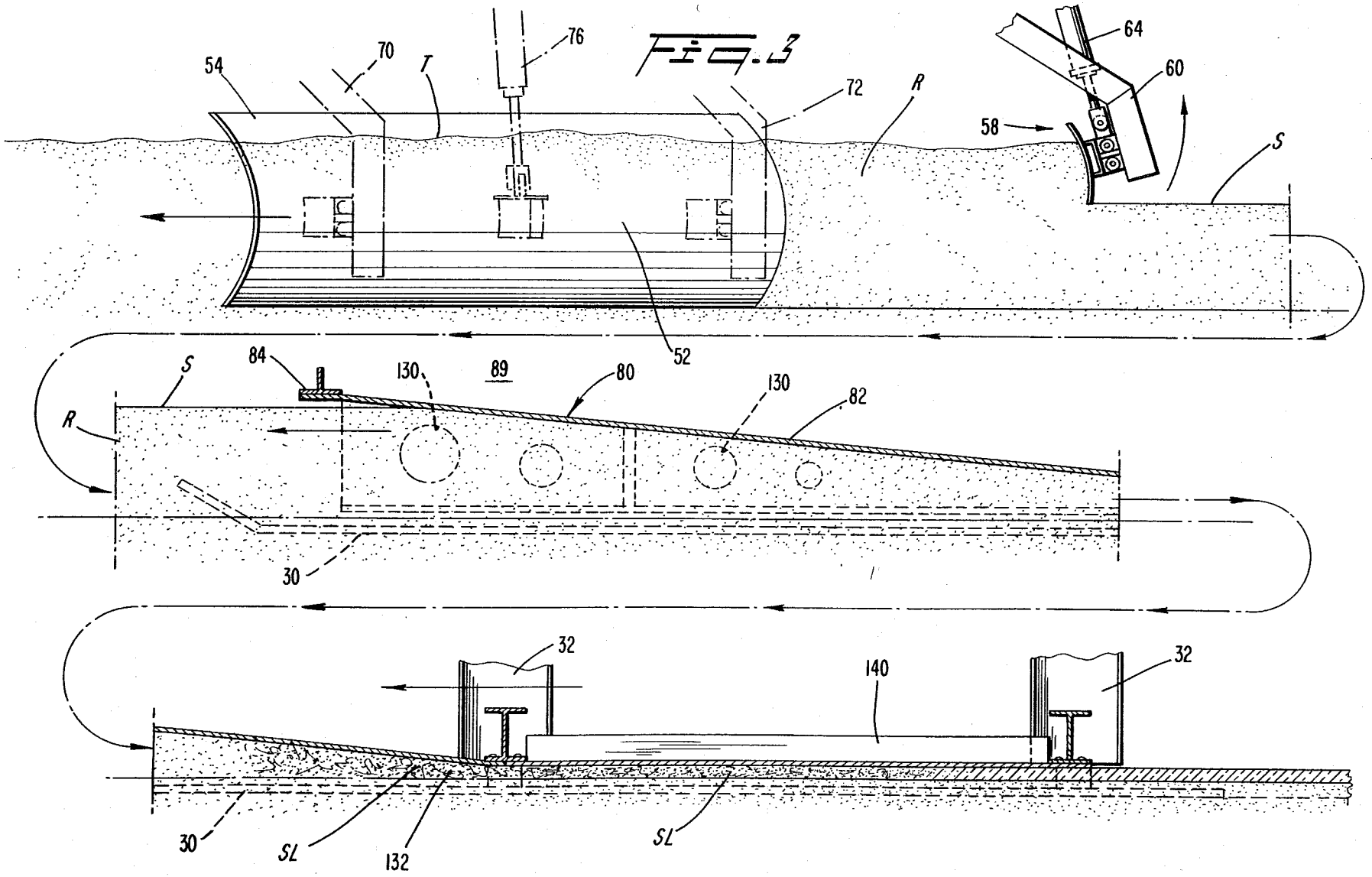
FIG. 3 is a side view, partially in longitudinal section, depicting in enlarged scale, the snow gathering, snow leveling, snow melting, and slush shaping components of the machine.

Mounted on the intermediate frame section 10C is a snow gathering arrangement 50 which constitutes an implement for displacing snow longitudinally inwardly of the frame and forming same into an elongated, endless ridge R extending in the direction of travel (FIG. 3). In particular, the snow gathering implement comprises a pair of wing blades 54 which converge in a rearward direction (FIG. 2) and are spaced apart laterally at their rear ends to form a snow discharge passage 56. As the machine advances along a snow-covered terrain, the wing blades contact snow and deflect same inwardly to the central discharge passage 56. The ridge R of snow discharged from the passage 56 has generally straight upright sides and an uneven top T. Acting upon the thus-formed ridge is a leveling blade 58 located behind and above the discharge passage. The leveling blade scrapes the top of the ridge R to form a flat uniform upper surface S on the ridge. It will be appreciated that the final ridge has a generally constant width and depth, the depth being established mainly by the particular elevation of the leveling blade 58. In this regard, the leveling blade 58 is mounted on a vertically adjustable support 60 which is attached at its front end to the intermediate frame section 10C by a pivot 62 enabling the rear end of the support 60 to be raised and lowered by hydraulic rams 64. The rams 64 are pivotably connected to the frame 10 and the support 60.

The wing blades are each mounted on vertically adjustable supports 70, 72 which are pivotably mounted to the intermediate frame section 10C by pivots 74 which form a common pivot axis enabling the outer ends of the supports 70, 72 to be raised and lowered by hydraulic rams 76. The rams 76 are each pivotably connected to the frame 10 and the respective wing blade 54.

Mounted on the rear frame section 10C is a melting chamber in which the snow ridge R is heated and partially melted to form a slush SL of water and snow (FIG. 3) which is thereafter exposed to the frigid ambient air to refreeze and form a rigid ice layer.

Figures 4, 5:
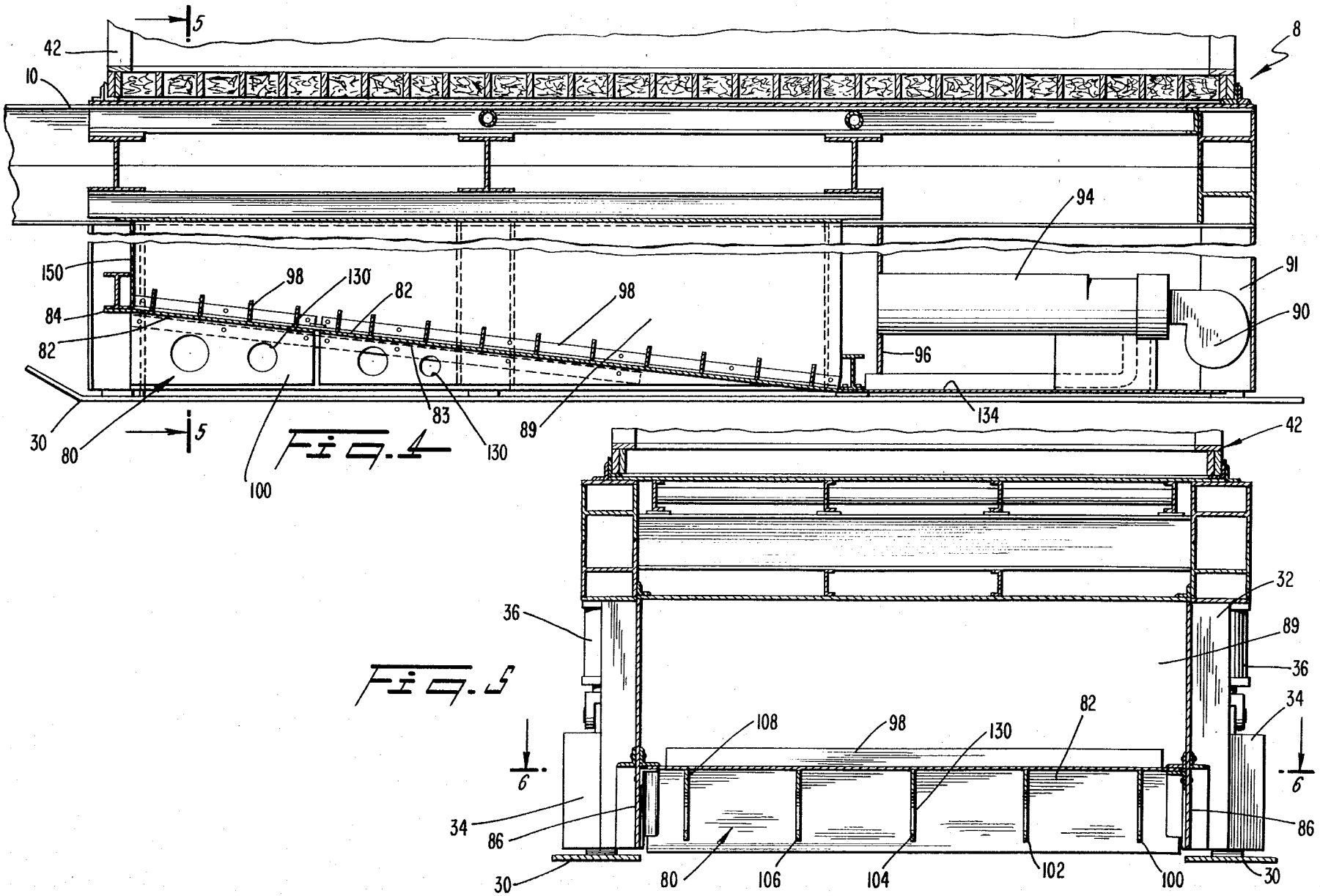
FIG. 4 is a longitudinal sectional view through a rear portion of the machine taken along line 4—4 in FIG. 2.
FIG. 5 is a cross-sectional view through the snow melting portion of the machine taken along line 5—5 in FIG. 4.

The melting chamber 80 comprises an inclined plate 82 which is inclined downwardly toward the rear of the frame. The plate 82 extends across substantially the full width of the machine and has its upper end 84 located at or above the elevation of the upper surface S of the snow ridge R. The melting chamber 80 includes longitudinal side walls 86 (FIG. 5) which confine the sides of the snow ridge R. The plate includes a bottom surface 83 which is arranged in the path of the snow ridge R. As the melting chamber 80 advances over the snow ridge R, the bottom surface 83 of the plate 82 presses downwardly against the snow ridge.

Situated above the plate is an enclosed heating compartment 89 which is heated by a series of oil fired burners 90 located in a separate, enclosed rear compartment 91. Heat is ducted into the heating chamber 89 via a duct 94 which extends through a wall 96 separating the compartments 89, 91. Heat is transferred to the plate 82, aided by a series of criss-crossing heat transfer fins 98 disposed on the top surface of the plate 84. Depending from the heating plate 82 are a series of vertical heat transfer vanes 100–108 which are welded to the plate 82 by continuous bead welds to maximize the transmission of heat from the plate 82 to the vanes.

The heating plate 82 and the vanes 100–108 are maintained sufficiently hot to transform some of the snow in the ridge from a frozen state to a liquid state at about 32° F. to form a slurry or slush of water and unmelted snow.

Preferably one or more of the vanes extends longitudinally, i.e., parallel to the fore-to-aft direction and also vertically the full height of the snow ridge. In the disclosed embodiment, the centermost vane 104 is so oriented. The other vanes are of slightly shorter height and are disposed at a slight angle (e.g., 15 degrees) relative to the fore-to-aft direction. As the plate 82 and vanes 100–108 pass through the ridge, partial melting throughout essentially the entire ridge takes place. The angled vanes 100, 102, 106 and 108 produce a churning action on the water due to their angular orientation. Holes 130 in the vanes 100–108 enable the water to travel to and from the channels formed by the vanes. This water movement occurs in an undulating pattern through the holes and produces a uniform mixture of water/snow in the slush being formed. This is important in achieving a uniform freezing action and a smooth ice surface and constant ice thickness.

In lieu of the vane arrangement depicted herein, an alternate preferred arrangement comprises four longitudinal vanes and twelve angled vanes.

The vanes extend along at least a substantial portion of the length of the heating plate 82 to produce a melting of the snow throughout the melting chamber 80.

As noted earlier, the slush is essentially at the freeze point (32° F.) but in a partially liquified form. Thus, the latent heat or fusion needed to form the slush into a solid ice road is only that needed to transform the liquid back into the solid state.

As the machine continues to advance, a horizontal rear plate 134 on the frame passes over the slush. This plate 134 forms the floor of the rear compartment 91 housing the burners 90. The rear plate 134 and compartment 91 are unheated, so that the slush begins to solidify. As the slush solidifies, its shape is maintained by the rear plate 134 and the side walls 86, the vertical elevation of the rear plate 134 determining the thickness of the ice road.

Finally, there emerges from the back end of the rear plate 134 a layer L of soft ice of generally uniform width and thickness. Final solidification of this soft ice occurs quickly in the frigid ambient air.

The machine 8 can make repeated passes over the ice base to gather and melt additional snow and gradually build-up the thickness of the road. Movement of the machine 8 is produced by means of a towing vehicle as noted earlier. Alternatively, however, the machine could be pushed or be capable of self-propulsion.

The rear plate 134 may include a plurality of fore-to-aft stiffener ribs 140 for reinforcement.

The heating compartment 89 is heavily insulated to minimize heat loss and conserve fuel. Fuel oil is delivered to the burners 90 from storage tanks 140 mounted at the back of the frame 10. Products of combustion from the burners exits the heating compartment 89 via outlet manifolds 142 and upright exhaust stacks 144 on opposite sides of the cabin. Such exhaust gases also exit the compartment 89 via outlet manifolds 146 communicating with the chamber 89 through a front wall 150 of the chamber 89.

It will be appreciated that the ice road formed by the present invention is made from snow and thus is salt free. Accordingly, the freeze period is shorter and the melting temperature of the finished road is higher. Also, the deterioration rate of the road is lessened and the road produces no salt-induced corrosion of vehicles on the road.

Since no liquid is pumped-out from beneath the road, there is no tendency for the road to sink. Importantly, the water which forms the road is confined during the freeze period, so that a road of a desired uniform width and thickness is achieved. Accomplishment of this result is aided by the fact that the water is in the form of a slush which is relatively easily confined and shaped. Moreover, the temperature of the formed slush is essentially at the freeze point, so it is only necessary to transform the water from a liquid state to a solid state to achieve a full freeze. This is achieved much more quickly than is necessary to cool-down the water from a higher temperature.

Although the invention has been described in connection with a preferred embodiment thereof, it will be appreciated by those skilled in the art, that additions, modifications, substitutions, and deletions not specifically described, may be made without departing from the spirit and scope of the invention as defined in the appended claims.

What is claimed is:

1. Apparatus for forming an ice road over snow-covered terrain, comprising:

a mobile frame, terrain support means mounted on said frame to support said frame upon the terrain as the frame advances, a ridge forming means mounted on said frame for forming snow into a ridge extending along the path of travel of said frame, and heating means mounted on said frame and arranged to pass along the ridge to form a slush of mixed water and snow of generally uniform depth and width which thereafter freezes, said heating means comprising:

a heating plate disposed behind said forming means, and including a bottom surface arranged in the path of the snow ridge and being inclined downwardly in a rearward direction, and a heating compartment disposed above said heating plate and including means for applying heat to a top surface of said plate to heat said bottom surface such that contact between said bottom surface and the snow ridge causes snow to be melted.

2. Apparatus according to claim 1 including a horizontal unheated plate behind said heating plate to shape the slush as it cools.

3. Apparatus according to claim 1 including means for vertically adjusting said support means to vary the elevation of said heating plate relative to the terrain.

4. Apparatus according to claim 1, including means for vertically adjusting the elevation of said forming means.

5. Apparatus for forming an ice road across snow-covered terrain, comprising:

a mobile frame, terrain-supporting skids at front and rear ends of said frame, a pair of rearwardly converging wing blades mounted on said frame for gathering snow inwardly to form an endless ridge, a leveling blade mounted on said frame behind said wing blades for leveling the top of the ridge, a rearwardly and downwardly inclined plate mounted on said frame behind said leveling blade and arranged in the path of the ridge for passing over the ridge, said plate including top and bottom surfaces, a plurality of generally fore-to-aft extending vanes depending downwardly from said bottom surface of said plate, which vanes are arranged to pass through the ridge, combustion heater means on said frame for applying heat to said top surface to heat said bottom surface and vanes to melt a portion of the ridge and form a slush of generally uniform depth and width at about 32° F., and a horizontal unheated plate behind said plate for shaping the slush as it freezes.

6. A method of forming an ice road over snow-covered terrain comprising the steps of:

A. traversing a pair of rearwardly converging snow gathering means over the snow-covered terrain to form a continuous ridge of snow, B. leveling the top of the ridge with a leveling blade, C. heating a rearwardly and downwardly inclined plate by burning a combustible fuel and directing the resultant heat into a heating compartment disposed above said plate, D. passing a heated bottom surface of said plate over the top of the ridge, and passing through the ridge a plurality of heated fore-aft vanes depending from said bottom surface to melt some of the snow in the ridge and form a slush of water and snow of generally uniform depth and width and of a temperature of about 32° F., and E. allowing the slush to at least partially freeze while confined beneath a horizontal unheated plate.

* * * * *